US007312651B2

(12) United States Patent
Kudo

(10) Patent No.: US 7,312,651 B2
(45) Date of Patent: Dec. 25, 2007

(54) CASCODE CURRENT MIRROR CIRCUIT OPERABLE AT HIGH SPEED

(75) Inventor: Masahiro Kudo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 76 days.

(21) Appl. No.: 11/061,619

(22) Filed: Feb. 22, 2005

(65) Prior Publication Data

US 2006/0114055 A1 Jun. 1, 2006

(30) Foreign Application Priority Data

Nov. 30, 2004 (JP) ..... 2004-346826

(51) Int. Cl.
*G05F 3/02* (2006.01)

(52) U.S. Cl. ..... 327/540; 327/541; 330/288

(58) Field of Classification Search ..... 327/540, 327/541; 323/315, 316; 330/288
See application file for complete search history.

(56) References Cited

U.S. PATENT DOCUMENTS 4,588,941 A * 5/1986 Kerth et al. ..... 323/314
5,087,891 A * 2/1992 Cytera ..... 330/288
6,313,692 B1 * 11/2001 Pease ..... 327/538
6,377,085 B1 * 4/2002 Giuroiu ..... 327/66

OTHER PUBLICATIONS

Joseph N. Babanezhad et al., "A Programmable Gain/Loss Circuit," IEEE Journal of Solid-State Circuits, vol. SC-22, No. 6, Dec. 1987, pp. 1082-1090.

* cited by examiner

*Primary Examiner*—Kenneth B. Wells
(74) *Attorney, Agent, or Firm*—Arent Fox LLP

(57) ABSTRACT

A current mirror circuit includes a first transistor having a source node connected to a reference potential, a second transistor having a source node coupled to a drain node of the first transistor and a gate node connected to a first predetermined potential, an inverted amplification circuit having a non-inverted input node coupled to a drain node of the second transistor, an inverted input node coupled to a second predetermined potential, and an output node coupled to a gate node of the first transistor, a third transistor having a gate node connected to a potential substantially equal to a potential of the gate node of the first transistor, and a fourth transistor having a gate node connected to a potential substantially equal to a potential of the gate node of the second transistor.

2 Claims, 7 Drawing Sheets

CASCODE CURRENT MIRROR CIRCUIT OPERABLE AT HIGH SPEED

BACKGROUND OF THE INVENTION

1. Field of the Invention

The present invention generally relates to circuits for controlling an electric current, and particularly relates to a cascode current mirror circuit.

2. Description of the Related Art

The cascode current mirror circuit has features such as extremely high output resistance and relatively high operation speed, and is used as an important analog circuit element. In the cascode current mirror circuit, transistors are arranged in tandem, which ends up lowering the voltage margin of the circuit. There is a circuit construction known to overcome this shortcoming and suitable for low-voltage operation (e.g., Non-patent Document 1). Such circuit construction is widely use.

FIG. 1 is a circuit diagram showing an example of a related-art cascode current mirror circuit. The circuit of FIG. 1 includes a current source I1, a current source I3, and NMOS transistors M11, M12, M21, M22, and M3, In the following description, a threshold voltage of a transistor is denoted as Vth, a gate-source voltage denoted as Vgs, and a drain-source voltage denoted as Vds. In order to discriminate each transistor, further, Vth, Vgs, and Vds are suffixed to indicate the threshold voltage, the gate-source voltage, and the drain-source voltage of a corresponding transistor. In order for a transistor to operate in the saturation region, the drain-source voltage needs to be no less than Vgs-Vth. This minimum necessary drain-source voltage (Vgs-Vth) is defined as Vdsat.

The transistors M11 and M21 have their gates connected to each other to make up a current mirror circuit. The transistors M12 and M22 also have their gates connected to each other to make up a current mirror circuit. An electric current (in the amount of I1) generated by the reference current source I1 flows through the transistors M11 and M12. The transistors M21 and M22 constituting a current outputting circuit operate in the substantially same bias conditions as M11 and M12 to output the electric current I2. With a ratio between the respective sizes of the transistors M11 and M12 and a ratio between the respective sizes of the transistors M12 and M22 being set to a desired ratio, it is possible to generate the output current I2 having the desired ratio relative to the reference current I1.

In this configuration, a rise in a potential V1 prompts the current running through the transistor M11 to become greater than the reference current I1. In response, the drain potential of the transistor M12 is pulled down. The drain potential of the transistor M12 is connected to the potential V1, so that feedback control is effected to pull down the potential V1. A fall in the potential V1, on the other hand, prompts the current running through the transistor M11 to become smaller than the reference current I1. In response, the drain potential of the transistor M12 is pulled up. The drain potential of the transistor M12 is connected to the potential V1, so that feedback control is effected to pull up the potential V1.

In order for the circuit of FIG. 1 to operate properly, all the transistors in the circuit need to operate in the saturation region. In the following, a description will be given of the conditions required for M11 and M12 to operate in the saturation region.

The current source I3 and the transistor M3 generate a gate-node voltage V2 of the transistor M12. The conditions required for M11 and M12 to operate in the saturation region are Vdsat11<Vds11 and Vdsat12<Vds12. Since Vdsat11=V1−Vth11 and Vds12=V1−Vds11, at least Vdsat12<Vth11 needs to be satisfied.

The transistors M12 and M22 are in the identical bias conditions, so that Vdsat of M22 is substantially equal to Vdsat12. With regard to frequency response characteristics of the transistor M22 used in the cascode stage in the current outputting circuit of the cascode current mirror circuit, a cut-off frequency indicative of such characteristics can be approximated by gm/Cp by using the gm of the transistor and a parasitic capacitance Cp. The mutual conductance gm in the saturation region can be regarded as approximately proportional to (W/L) Vdsat by using a gate width W, gate length L, and Vdsat of the transistor. Cp can be regarded as approximately proportional to WL. Accordingly, the cut-off frequency gm/Cp indicative of the frequency response characteristics can be regarded as approximately proportional to $Vdsat/L^2$.

From the above description, it is understood that the frequency response characteristics of the transistor M22 can be improved by making L shorter or by increasing Vdsat22 that is the Vdsat of M22. Since the minimum gate length is determined by the process technology for the transistor, there is a limit to the shortening of L. Also, there are cases in which it is preferable to have L longer than the minimum gate length for the purpose of avoiding a short-channel effect created by the shortening of the transistor gate length. Accordingly, there is a need to increase Vdsat22 as much as necessary if desired frequency response characteristics are to be achieved for M22.

[Non-patent Document] J. N. Babanezhad and R. Gregorian, "A Programmable Gain/Loss Circuit," IEEE J. of Solid-State Circuits, Vol. 22, No. 6, pp. 1082-1090, December 1987

When the circuit of FIG. 1 is used, as described above, a limit Vth11 exists as a maximum possible value of Vdsat22, i.e., Vdsat12. A further description will be given here with regard to this point. Vdsat12 needs to be increased in order to achieve desired frequency response characteristics. In order to increase Vdsat12, it is necessary to increase Vgs12. If the gate voltage of the transistor M12 is raised for this purpose, it becomes necessary to raise the drain voltage V1 of M12 so as to secure an operation in the saturation region for M12. Since the voltage V1 is also the gate voltage of the transistor M11, a widening of the gap between the gate voltage V1 and Vth11 makes it difficult to secure an operation in the saturation region for M11. Accordingly, there is an upper limit to Vdsat12 in relation to Vth11 when an attempt is made to raise Vdsat12.

As a result, the frequency response characteristics of the transistor M22 have limitations. It is thus not possible to design a circuit that is faster than certain speed.

The transistor threshold voltage Vth is a device-dependent voltage. Basically, it cannot be set freely, and varies depending on process conditions and temperature. The value of Vdsat12 that is settable at the time of design is thus a lower limit of the range defined by varying process conditions and temperature. Namely, the speed of the circuit has its limit corresponding to this lower limit determined according to the circuit construction. The above description has been provided with reference to an example in which the cascode current mirror circuit is implemented by use of NMOS transistors. The same also applies in the case of a cascode current mirror circuit implemented by use of PMOS transistors.

Accordingly, there is a need for a cascode current mirror circuit that can achieve desired speed while securing an operation in the saturation region.

SUMMARY OF THE INVENTION

It is a general object of the present invention to provide a current mirror circuit that substantially obviates one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a current mirror circuit particularly pointed out in the specification in such full, clear, concise, and exact terms as to enable a person having ordinary skill in the art to practice the invention.

To achieve these and other advantages in accordance with the purpose of the invention, the invention provides a current mirror circuit, which includes a first transistor having a source node connected to a reference potential, a second transistor having a source node coupled to a drain node of the first transistor and a gate node connected to a first predetermined potential, an inverted amplification circuit having a non-inverted input node coupled to a drain node of the second transistor, an inverted input node coupled to a second predetermined potential, and an output node coupled to a gate node of the first transistor, a third transistor having a gate node connected to a potential substantially equal to a potential of the gate node of the first transistor, and a fourth transistor having a gate node connected to a potential substantially equal to a potential of the gate node of the second transistor.

According to another aspect of the present invention, a current mirror circuit includes a first transistor having a source node connected to a reference potential, a second transistor having a source node coupled to a drain node of the first transistor and a gate node connected to a first predetermined potential, a current-controlled current source, having an input node coupled to a drain node of the second transistor and an output node coupled to a gate node of the first transistor, configured to generate at the output node a current having current amount responsive to an amount of a current flowing from the input node to the second transistor, a third transistor having a gate node connected to a potential substantially equal to a potential of the gate node of the first transistor, and a fourth transistor having a gate node connected to a potential substantially equal to a potential of the gate node of the second transistor.

According to another aspect of the present invention, a current mirror circuit includes a first transistor having a source node connected to a reference potential, a second transistor having a source node coupled to a drain node of the first transistor and a gate node connected to a first predetermined potential, a shift-voltage generating circuit, having a first node coupled to a drain node of the second transistor and a second node coupled to a gate node of the first transistor, configured to generate a predetermined potential difference between the first node and the second node, a third transistor having a gate node connected to a potential substantially equal to a potential of the gate node of the first transistor, and a fourth transistor having a gate node connected to a potential substantially equal to a potential of the gate node of the second transistor.

According to at least one embodiment of the present invention, one of the inverted amplification circuit, the current-controlled current source, and the shift-voltage generating circuit is inserted into the path that couples between the drain potential of the cascode-stage transistor and the gate potential of the source-grounded-stage transistor in the cascode current mirror circuit. This makes it possible to separate the drain potential of the cascode-stage transistor from the gate potential of the source-grounded-stage transistor, thereby setting them to different potentials. With this provision, it is possible to set the speed (frequency response characteristics) of the cascode current mirror circuit to a desired speed by raising Vdsat while securing an operation in the saturation region for each transistor.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

Figure 1:
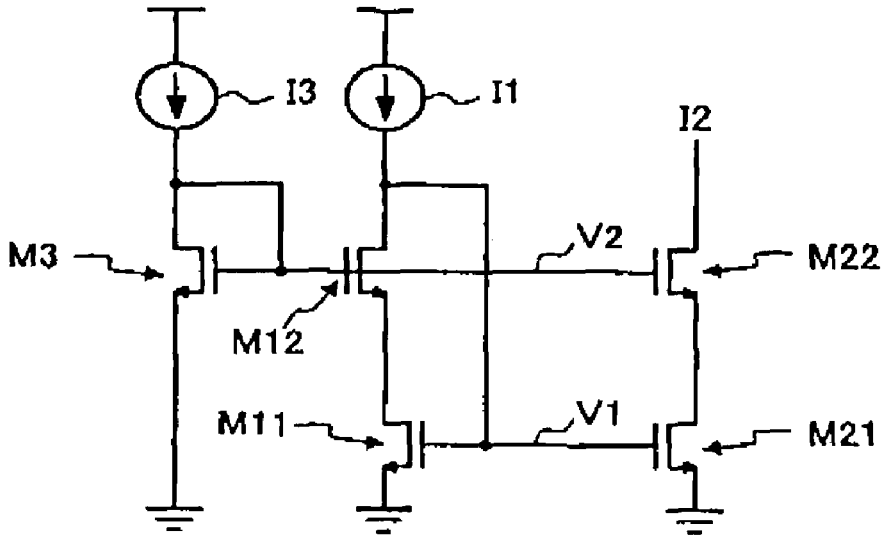
FIG.1 (Prior Art)
FIG. 1 is a circuit diagram showing an example of a related-art cascode current mirror circuit.

The principle of the present invention that achieves desired speed while securing an operation in the saturation region resides in the fact that the input side and output side of the feedback path for feedback control are separated from each other in the cascode current mirror circuit. Using the related-art configuration shown in FIG. 1 as an example, the path that supplies the drain potential of the transistor M12 of the cascode stage as a gate potential to the transistor M11 of the source-grounded stage is the feedback path for feedback control. The input side of this feedback path (i.e., the drain potential of the transistor M12 in this example) is separated from the output side (i.e., the gate potential of the transistor M11), thereby making it possible to set them to respective, different potentials. With this provision, it is possible to set the speed (frequency response characteristics) of the cascode current mirror circuit to a desired speed by raising Vdsat22, i.e., Vdsat12, while securing an operation in the saturation region for each transistor.

In the present invention, the above-noted configuration is achieved by using different means. All these means, however, share the same principle that the input side and output side of the feedback path are separated from each other.

Figure 2:
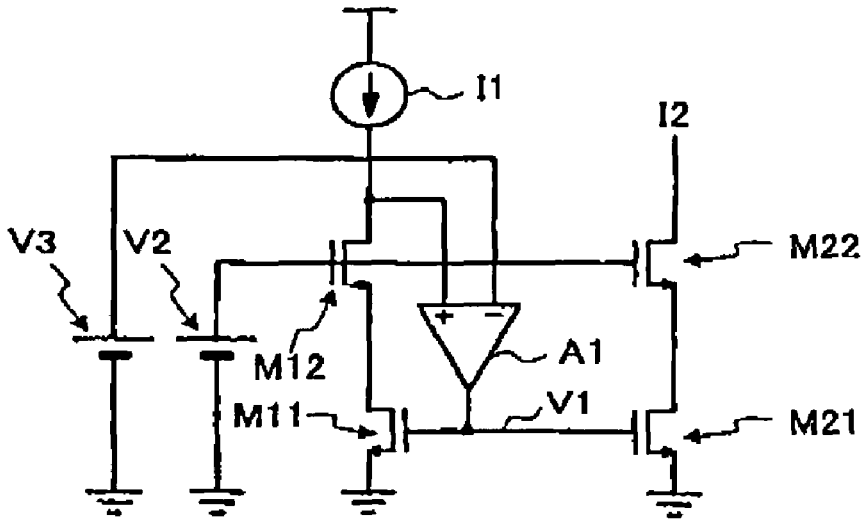
FIG. 2 is a circuit diagram showing an example of the construction of a cascode current mirror circuit according to a first embodiment of the present invention.

FIG. 2 is a circuit diagram showing an example of the construction of a cascode current mirror circuit according to a first embodiment of the present invention. The cascode current mirror circuit of FIG. 2 includes a current source I1, a bias-voltage generating circuit V2, a bias-voltage generating circuit V3, NMOS transistors M11, M12, M21, and M22, and a differential amplifier A1. The output node of the differential amplifier A1 is connected to the gate node of the transistor M11, which is a source-grounded stage of the current mirror. The non-inverted input node of the differential amplifier A1 is connected to the drain of the transistor M12 which is a cascode stage. The inverted input node receives a bias voltage V3, which is necessary to make the transistor M12 at the cascode stage operate in the saturation region.

The transistors M11 and M21 have their gates connected to each other to make up a current mirror circuit. The transistors M12 and M22 also have their gates connected to each other to make up a current mirror circuit. An electric current (in the amount of I1) generated by the reference current source I1 flows through the transistors M11 and M12. The transistors M21 and M22 constituting a current outputting circuit operate in the substantially same bias conditions as M11 and M12 to output the electric current I2. With a ratio between the respective sizes of the transistors M11 and M12 and a ratio between the respective sizes of the transistors M12 and M22 being set to a desired ratio, it is possible to generate the output current I2 having the desired ratio relative to the reference current I1.

In this configuration, the drain potential of the transistor M12 is controlled to be substantially equal to the potential V3 through a negative feedback loop comprised of the differential amplifier A1 and the transistors M11 and M12. At the same time, the gate potential V1 of the transistor M11 is controlled through the negative feedback loop such that the current running through the transistor M11 becomes equal to the reference current I1. With this provision, it is possible to set the drain-node potential of the transistor M12 to a different potential than the gate-node potential of the transistor M11.

The conditions required for M11 and M12 to operate in the saturation region are Vdsat11<Vds11 and Vdsat12<Vds12. Since Vdsat11=V1−Vth11 and Vds12=V3−Vds11, it suffices for Vdsat12 if Vdsat12<Vth11+V3−V1 is satisfied. As a result, an upper limit to Vdsat12 can be set high by employing a high potential as the potential V3. In the related-art configuration shown in FIG. 1, the upper limit to Vdsat12 for securing a saturation region operation is Vth11. According to the present invention, on the other hand, Vdsat12 can be set to any desired value exceeding Vth11.

Figure 3:
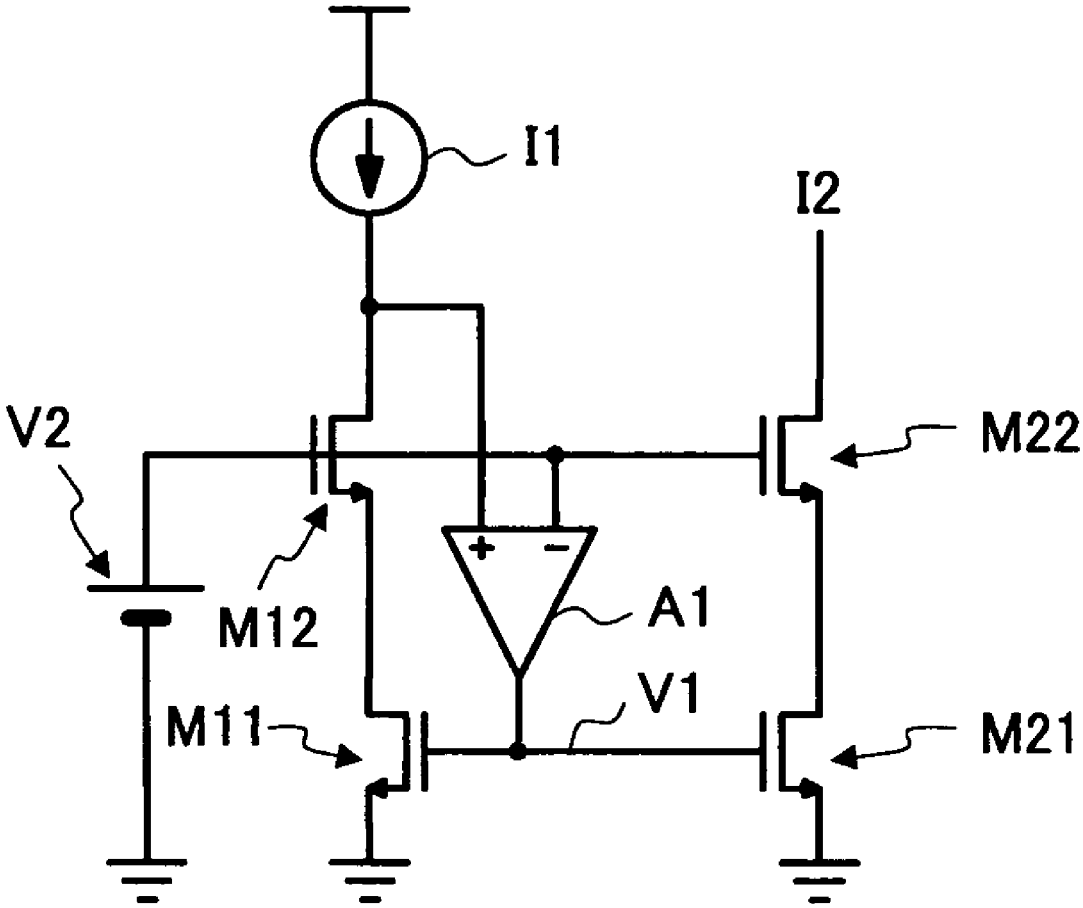
FIG. 3 is a drawing showing a variation of the circuit of FIG. 2.

FIG. 3 is a drawing showing a variation of the circuit of FIG. 2. The cascode current mirror circuit of FIG. 3 includes the current source I1, the bias-voltage generating circuit V2, the NMOS transistors M11, M12, M21, and M22, and the differential amplifier A1. The output node of the differential amplifier A1 is connected to the gate node of the transistor M11, which is a source-grounded stage of the current mirror. The non-inverted input node of the differential amplifier A1 is connected to the drain of the transistor M12 which is a cascode stage. The inverted input node is connected to the gate node of the transistor M12. Compared with the configuration shown in FIG. 2, thus, the bias-voltage generating circuit V3 is removed.

In this configuration, the drain node of the transistor M12 is controlled such as to be substantially equal to the potential V2 through the negative feedback loop. In this case, the conditions required for the transistor M12 to operate in the saturation region is Vdsat12<Vds12. Since Vdsat12=V2−Vds11−Vth12 and Vds12=V2−Vds11, the necessary conditions are Vth12>0. Accordingly, the transistor M12 is guaranteed to operate in the saturation region as long as the threshold voltage of the transistor M12 is positive.

Use of this configuration provides for the circuit to operate properly while securing an operation in the saturation region despite the fact that Vdsat12 is set to a desired value.

In order for the circuit of FIG. 2 or FIG. 3 to operate properly, the negative feedback loop comprised of the differential amplifier A1 and the transistors M11 and M12 needs to have a negative loop gain of sufficient magnitude. In general, a differential amplifier that outputs a voltage or current responsive to a differential between the two input voltages has sufficiently large input resistance. The drain node of the transistor M12 is coupled to the reference current source I1, a cascode circuit (M11 and M12), and the differential amplifier A1 having sufficiently large input resistance. Because of this, the drain node of the transistor M12 has extremely large output resistance with respect to the reference potential. This node having large output resistance and the mutual conductance gm of M11 are present along the negative feedback loop, so that a negative-feedback loop gain having sufficient magnitude is achieved even if the amplification factor of the differential amplifier A1 is small. Accordingly, the circuit of FIG. 2 and FIG. 3 operates properly.

The differential amplifier A1 may have a sufficiently large amplification factor, or the output resistance of the differential amplifier A1 or the capacitive load on the output node may be relatively large. In such a case, the phase margin of the negative feedback loop may become insufficient, resulting in the oscillation of the circuit. In this case, a capacitor for proper phase compensation or the like may be added to the circuit, thereby securing the stability of the circuit to ensure proper operation.

Figure 4:
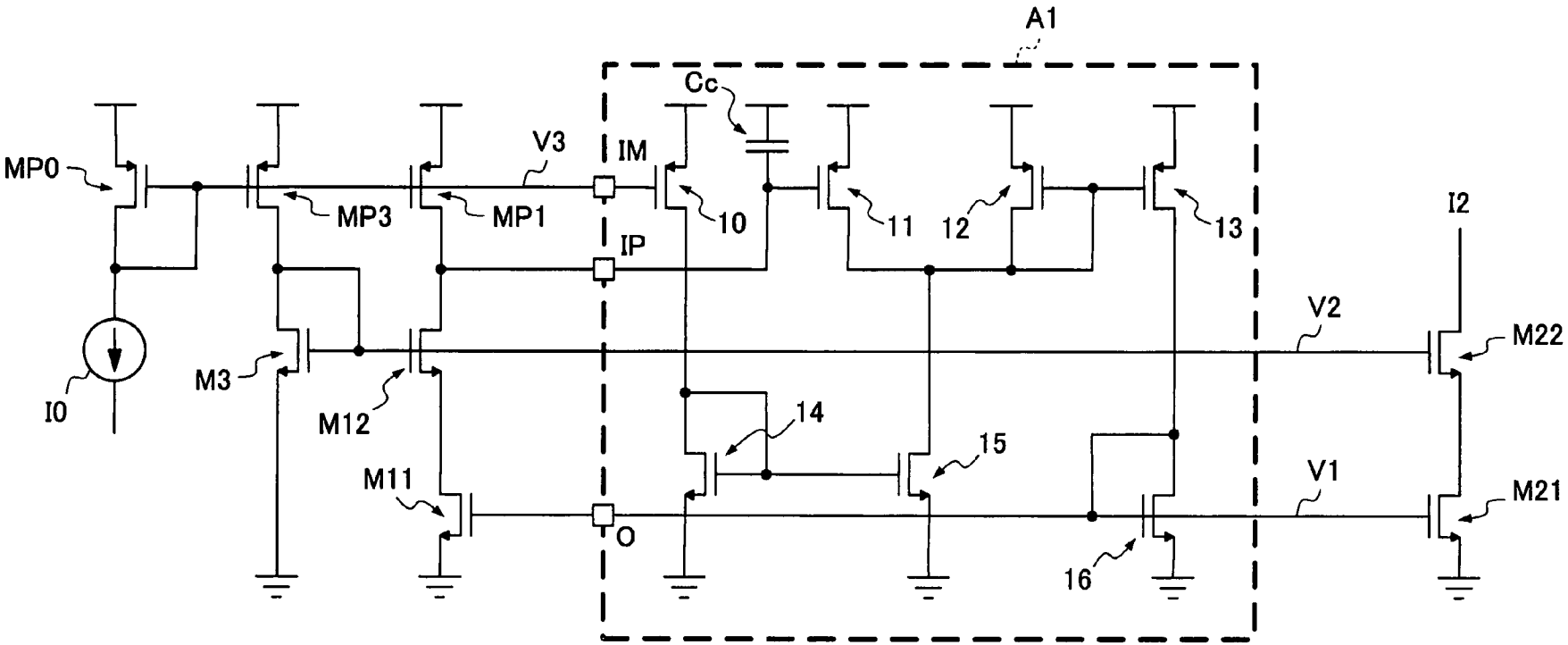
FIG. 4 is a circuit diagram showing an example of the circuit construction of a bias-voltage generating circuit and differential amplifier shown in FIG. 2.

FIG. 4 is a circuit diagram showing an example of the circuit construction of the bias-voltage generating circuit and differential amplifier shown in FIG. 2. In FIG. 4, the same elements as those of FIG. 2 are referred to by the same numerals.

A current source I0 and a transistor MP0 together constitute the bias-voltage generating circuit V3 shown in FIG. 2. The transistor MP0 and transistors MP1 and MP3 constitute a current mirror circuit, in which the transistors MP1 and MP3 each have a current I0 flowing therethrough. The transistor MP3 and the transistor M3 together make up the bias-voltage generating circuit V2 shown in FIG. 2. The transistor MP1 corresponds to the reference current source I1.

The differential amplifier A1 in FIG. 4 includes PMOS transistors 10 through 13, NMOS transistors 14 through 16, and a capacitor Cc. Nodes Ip, IM, and O correspond to the non-inverted input node, inverted input node, and output node of the differential amplifier, respectively. If W/L (W: gate width, L: gate length) is set equal among the PMOS transistors 10, 11, and 12, the W/L of the NMOS transistor 15 is set twice as large as the W/L of the NMOS transistor 14. When IP and IM receive the same voltage, and the differential amplifier A1 is thus in the equilibrium state, a current running through the PMOS transistor 11 responsive to the gate-node voltage IP (=IM) is equal to the current running through the NMOS transistor 16. The gate-node voltage of the NMOS transistor 16 at this time is output from the output node O.

A rise in the potential at the non-inverted input node IP results in a decrease in the current running through the PMOS transistor 11. Since the current running through the NMOS transistor 15 does not change at this time, the current running through the PMOS transistor 12 increases comparatively, resulting in an increase in the current flowing through the PMOS transistor 13. In response, the voltage appearing at the output node O rises such as to increase the current flowing through the NMOS transistor 16 accordingly.

A rise in the potential at the inverted input node IM results in a decrease in the current running through the PMOS transistor 10. This causes the current flowing through the NMOS transistor 14 and the current flowing through the NMOS transistor 15 to decrease. Since the current running through the PMOS transistor 11 does not change at this time, the current running through the PMOS transistor 12 decreases, resulting in reduction in the current flowing through the PMOS transistor 13. In response, the voltage appearing at the output node O falls such as to decrease the current flowing through the NMOS transistor 16 accordingly.

The amplification factor of the differential amplifier A1 is determined by a ratio of the mutual conductance gm of the PMOS transistor to the mutual conductance gm of the NMOS transistor. If there is a potential difference between IP and IM, the output potential changes by an amount equal to the potential difference with some amplification or attenuation. The capacitor Cc is an example of a phase compensation capacitor that is added for the purpose of stabilizing the operation of the negative-feedback system.

The above description has been given with reference to an example in which the cascode current mirror circuit is implemented by use of NMOS transistors. The present invention is equally applicable to a cascode current mirror circuit implemented by use of PMOS transistors.

Figure 5:
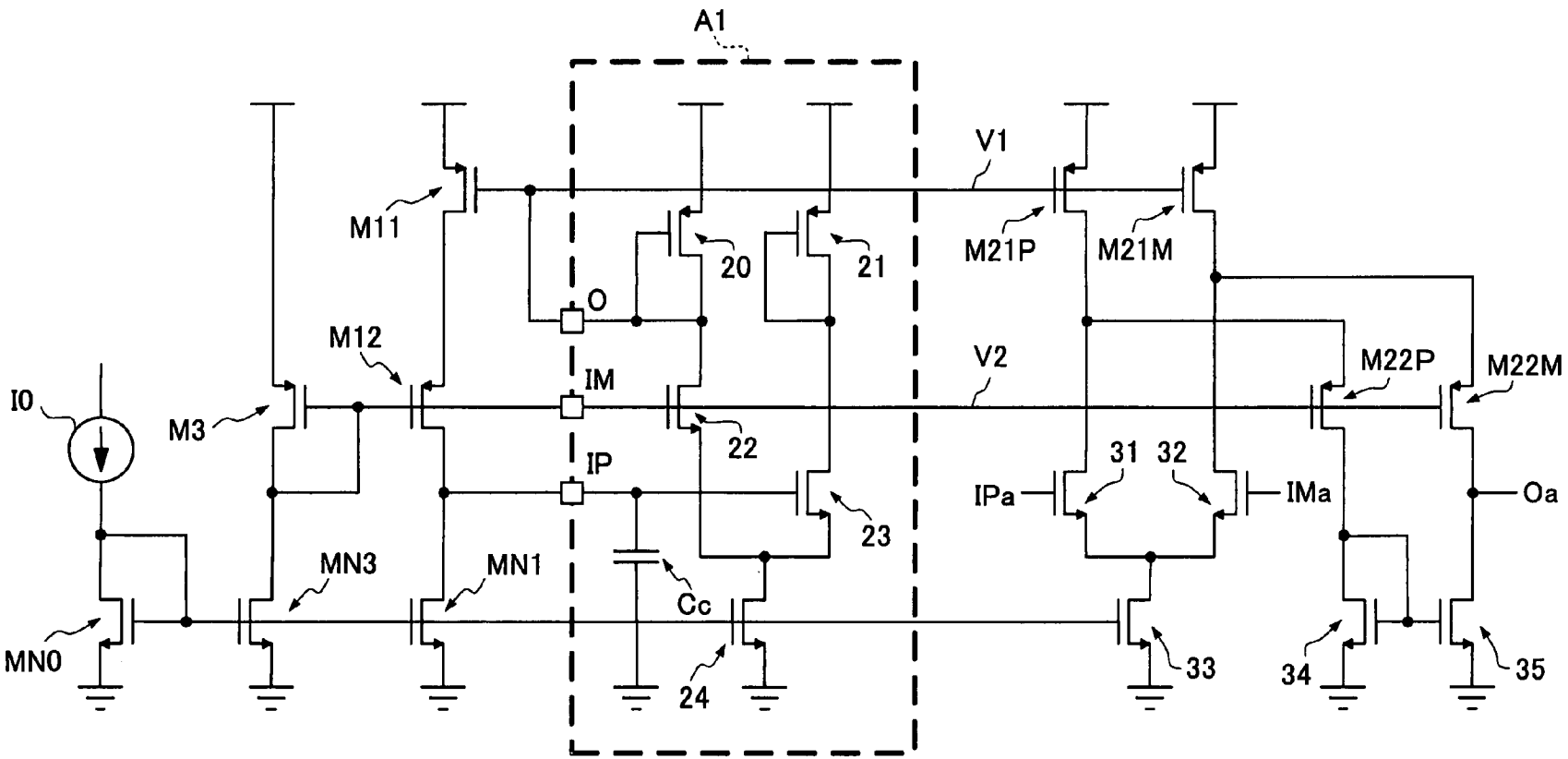
FIG. 5 is a circuit diagram showing an example of the construction in which the cascode current mirror circuit according to the first embodiment of the present invention is implemented by use of PMOS transistors.

FIG. 5 is a circuit diagram showing an example of the construction in which the cascode current mirror circuit according to the first embodiment of the present invention is implemented by use of PMOS transistors. In FIG. 5, the transistors M11 and M12 are circuit elements corresponding to the transistors M11 and M12 shown in FIG. 2, but are implemented as PMOS transistors in FIG. 5.

A current source I0 and a transistor MN0 together constitute the bias-voltage generating circuit V3 shown in FIG. 2. The transistor MN0 and transistors MN1 and MN3 constitute a current mirror circuit, in which the transistors MN1 and MN3 each have a current I0 flowing therethrough. The transistor MN3 and the transistor M3 together make up the bias-voltage generating circuit V2 shown in FIG. 2. The transistor MN1 corresponds to the reference current source I1.

The differential amplifier A1 in FIG. 5 includes PMOS transistors 20 and 21, NMOS transistors 22 through 23, and a capacitor Cc. Nodes Ip, IM, and O correspond to the non-inverted input node, inverted input node, and output node of the differential amplifier, respectively. When IP and IM receive the same voltage to attain an equilibrium state, the current I0 flows through each of the PMOS transistors 20 and 21. The gate-node voltage of the PMOS transistor 20 at this time is output from the output node O.

The amplification factor of the differential amplifier A1 is determined by a ratio of the mutual conductance gm of the NMOS transistor to the mutual conductance gm of the PMOS transistor. If there is a potential difference between IP and IM, the output potential changes by an amount equal to the potential difference with some amplification or attenuation. The capacitor Cc is an example of a phase compensation capacitor that is added for the purpose of stabilizing the operation of the negative-feedback system.

FIG. 5 demonstrates an example in which the current outputting circuit is a cascode amplifier. The gate-node voltage V1 of the transistor M11 is supplied to the gate node of the transistors M21P and M21M. Further, the gate-node voltage V2 of the transistor M12 is supplied to the gate node of the transistors M22P and M22M. An NMOS differential pair comprised of the NMOS transistors 31 through 33 is situated between M21P and M22P and between M21M and M22M. Further, a current mirror circuit comprised of the NMOS transistors 34 and 35 is situated between the ground node and the transistors M22P and M22M.

The NMOS differential pair receives potentials IPa and IMa, and an output potential Oa is obtained as am amplified signal responsive to the differential between these potentials. In such cascode amplifier as this, frequency response characteristics of the transistors M22P and M22M at the cascode stage are important. Namely, the transistors M22P and M22M need to be able to operate at high speed matching the speed of signal changes. According to the present invention, it is possible to set the speed (frequency response characteristics) of the cascode current mirror circuit and cascode amplifier to a desired value by making Vdsat sufficiently large for the transistors M22P and M22M while securing an operation in the saturation region with respect to each transistor.

Figure 6:
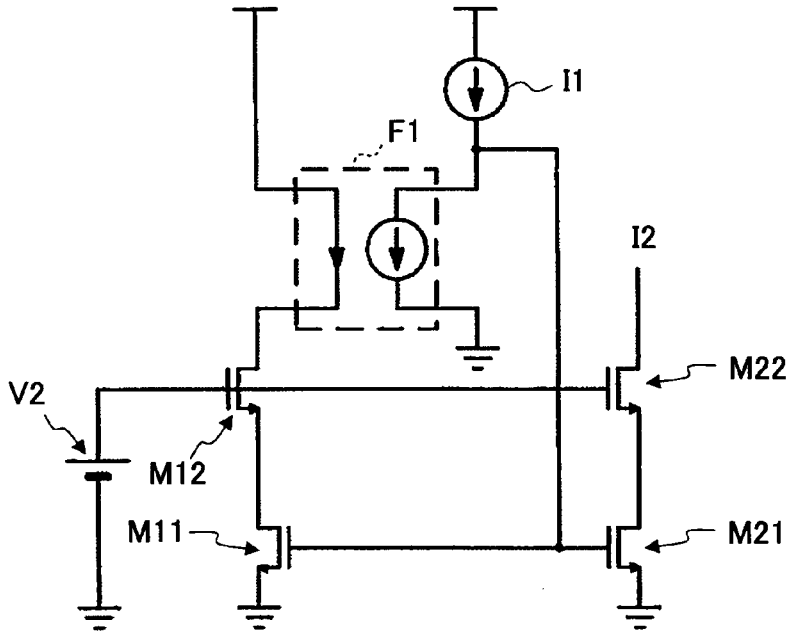
FIG. 6 is a circuit diagram showing an example of the construction of the cascode current mirror circuit according to a second embodiment of the present invention.

FIG. 6 is a circuit diagram showing an example of the construction of the cascode current mirror circuit according to a second embodiment of the present invention. In FIG. 6, the same elements as those of FIG. 2 are referred to by the same numerals.

The cascode current mirror circuit of FIG. 6 includes the current source I1, the bias-voltage generating circuit V2, the NMOS transistors M11, M12, M21, and M22, and a current-controlled current source F1. The current-controlled current source F1 controls the amount of an electric current on the output side such that the current flowing on the output side (i.e., the side connected to the current source I1) is responsive (i.e., equal to or proportional to) the current flowing on the input side (i.e., the side connected to the drain node of the transistor M12). The current on the input side and the current on the output side may be proportional to each other with a positive proportion factor, or may be proportional to each other with a negative proportion factor. In an example of FIG. 6, the circuit configuration is such that a positive proportional relationship is provided.

The node between the current-controlled current source F1 and the reference current source I1 is connected to the gate node of the transistor M11, which is a source-grounded stage of the current mirror. A rise in the gate-node voltage of the transistor M11 causes an increase in the current running through the transistor M11. Since the current flowing on the input side of the current-controlled current source F1 is increased, the current following on the output side of the current-controlled current source F1 starts to increase. In response, feedback control is effected to lower the gate-node voltage of the transistor M11. This feedback control serves to maintain an equilibrium state of the circuit.

The transistors M11 and M21 have their gates connected to each other to make up a current mirror circuit. The transistors M12 and M22 also have their gates connected to each other to make up a current mirror circuit. The transistors M21 and M22 constituting a current outputting circuit operate in the substantially same bias conditions as M11 and M12 to output the electric current I2. With a ratio between the respective sizes of the transistors M11 and M12 and a ratio between the respective sizes of the transistors M12 and M22 being set to a desired ratio, it is possible to generate the output current I2 having the desired ratio relative to the current flowing through the transistors M11 and M12.

In this configuration, the potential on the input side of the current-controlled current source F1 (i.e., the potential of the drain node of the transistor M12) is separate from the potential on the output side (i.e., the potential of the gate node of the transistor M11). That is, it is possible to set the drain-node potential of the transistor M12 to a different potential than the gate-node potential of the transistor M11. It is thus possible to achieve desired frequency response characteristics by setting Vdsat12 to a large value while securing an operation in the saturation region.

Figure 7:
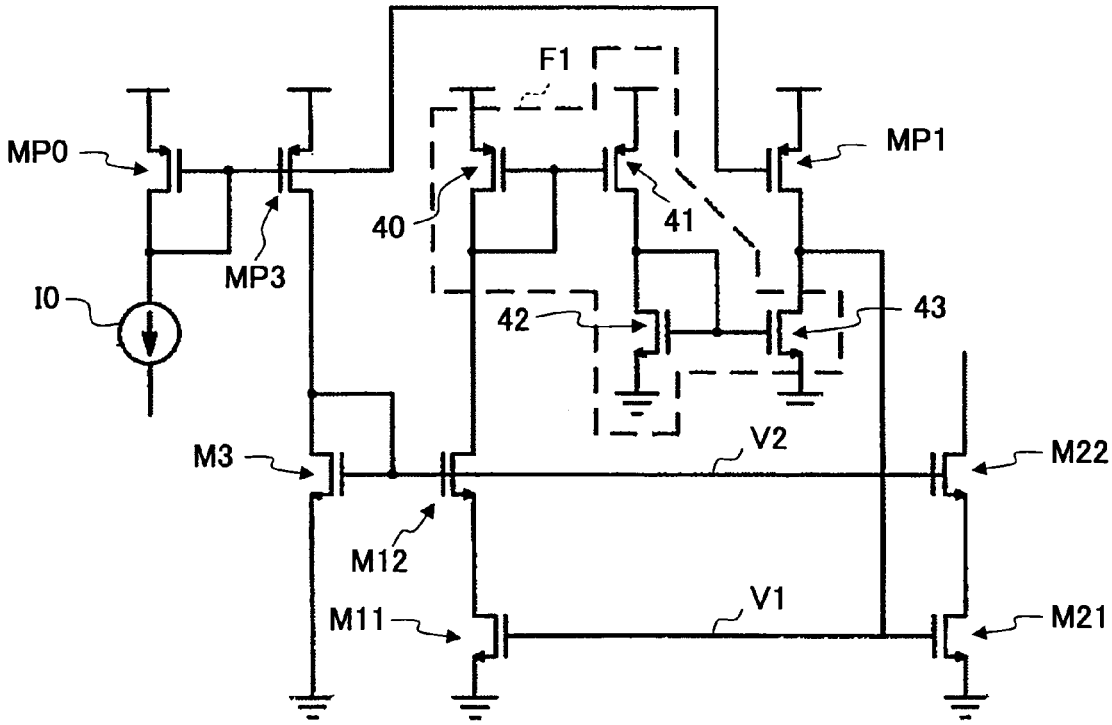
FIG. 7 is a circuit diagram showing an example of the circuit construction of a bias-voltage generating circuit and current-controlled current source shown in FIG. 6.

FIG. 7 is a circuit diagram showing an example of the circuit construction of the bias-voltage generating circuit and current-controlled current source shown in FIG. 6. In FIG. 7, the same elements as those of FIG. 6 are referred to by the same numerals.

A transistor MP0 connected to a current source I0 and transistors MP1 and MP3 constitute a current mirror circuit, in which the transistors MP1 and MP3 each have a current I0 flowing therethrough. The transistor MP3 and the transistor M3 together make up the bias-voltage generating circuit V2 shown in FIG. 6. The transistor MP1 corresponds to the reference current source I1.

The current-controlled current source F1 in FIG. 7 includes PMOS transistors 40 and 41 and NMOS transistors 42 and 43. The PMOS transistors 40 and 41 have their gate nodes connected to each other, and the NMOS transistors 42 and 43 have their gate nodes connected to each other. If the size of all the transistors is the same, the transistor 43 has a current running therethrough equal in amount to the current running through the transistor 40.

When the current flowing through the transistor 40 increases, the current flowing through the transistor 43 tries to grow larger than the current running through the transistor MP1 that serves as the reference current source I1. This pulls down the drain potential of the transistor MP1. When the current flowing through the transistor 40 decreases, on the other hand, the current flowing through the transistor 43 tries to grow smaller than the current running through the transistor MP1 that serves as the reference current source I1. This pulls up the drain potential of the transistor MP1.

Figure 8:
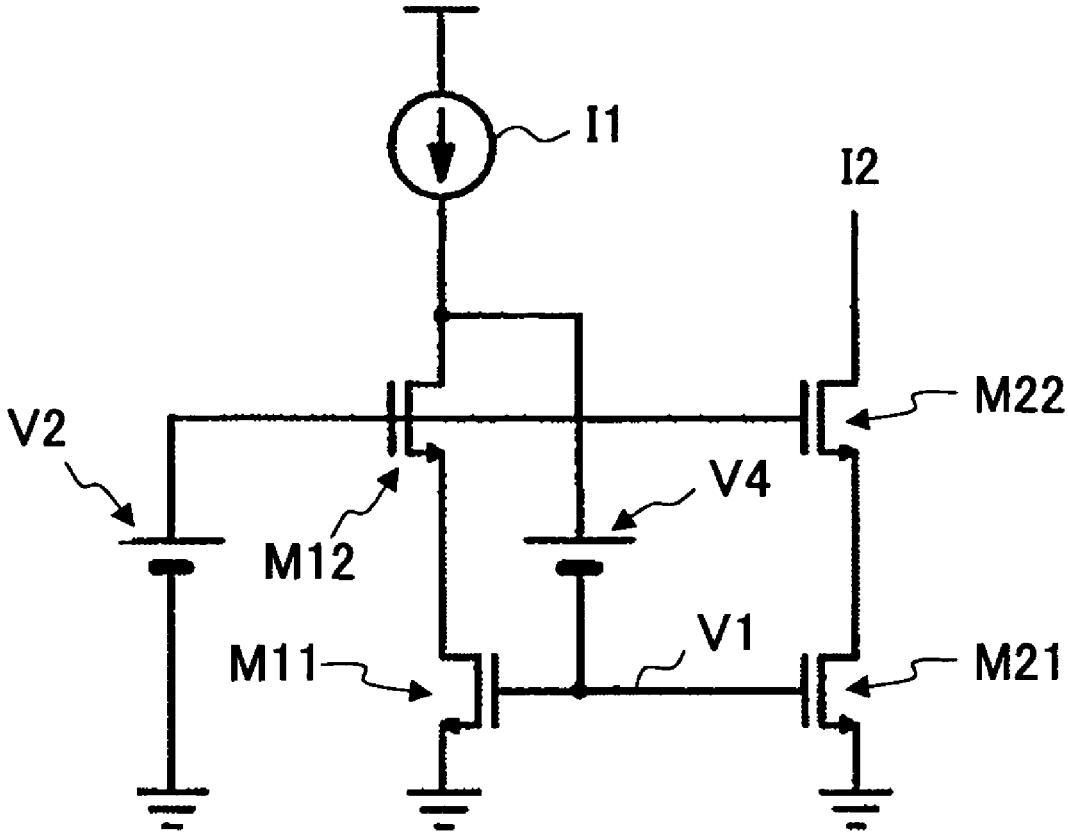
FIG. 8 is a circuit diagram showing an example of the construction of the cascode current mirror circuit according to a third embodiment of the present invention.

FIG. 8 is a circuit diagram showing an example of the construction of the cascode current mirror circuit according to a third embodiment of the present invention. In FIG. 8, the same elements as those of FIG. 2 are referred to by the same numerals.

The cascode current mirror circuit of FIG. 8 includes the current source I1, the bias-voltage generating circuit V2, the NMOS transistors M11, M12, M21, and M22, and a shift-voltage generating circuit V4. The shift-voltage generating circuit V4 has its minus side connected to the gate node of the transistor M11 and its plus side connected to the drain node of the transistor M12. With this provision, a potential made by subtracting a predetermined shift voltage from the drain-node potential of the transistor M12 appears at the gate node of the transistor M11.

The transistors M11 and M21 have their gates connected to each other to make up a current mirror circuit. The transistors M12 and M22 also have their gates connected to each other to make up a current mirror circuit. The transistors M21 and M22 constituting a current outputting circuit operate in the substantially same bias conditions as M11 and M12 to output the electric current I2. With a ratio between the respective sizes of the transistors M11 and M12 and a ratio between the respective sizes of the transistors M12 and M22 being set to a desired ratio, it is possible to generate the output current I2 having the desired ratio relative to the reference current I1.

In this configuration, a rise in the potential V1 causes the current running through the transistor M11 to try to grow larger than the reference current I1. In response, the drain potential of the transistor M12 is pulled down. The drain potential of the transistor M12 is coupled to the potential V1 through the shift voltage V4, so that feedback control is effected to lower the potential V1. A fall in the potential V1, on the other hand, causes the current running through the transistor M11 to try to grow smaller than the reference current I1. In response, the drain potential of the transistor M12 is pulled up. The drain potential of the transistor M12 is coupled to the potential V1 through the shift voltage V4, so that feedback control is effected to raise the potential V1.

In this configuration, the drain-node potential of the transistor M12 is a separate potential from the potential V1 of the gate node of the transistor M11, with the gap equal to the voltage V4. That is, it is possible to set the drain-node potential of the transistor M12 to a different potential than the gate-node potential of the transistor M11. It is thus possible to achieve desired frequency response characteristics by setting Vdsat12 to a large value while securing an operation in the saturation region.

Figure 9:
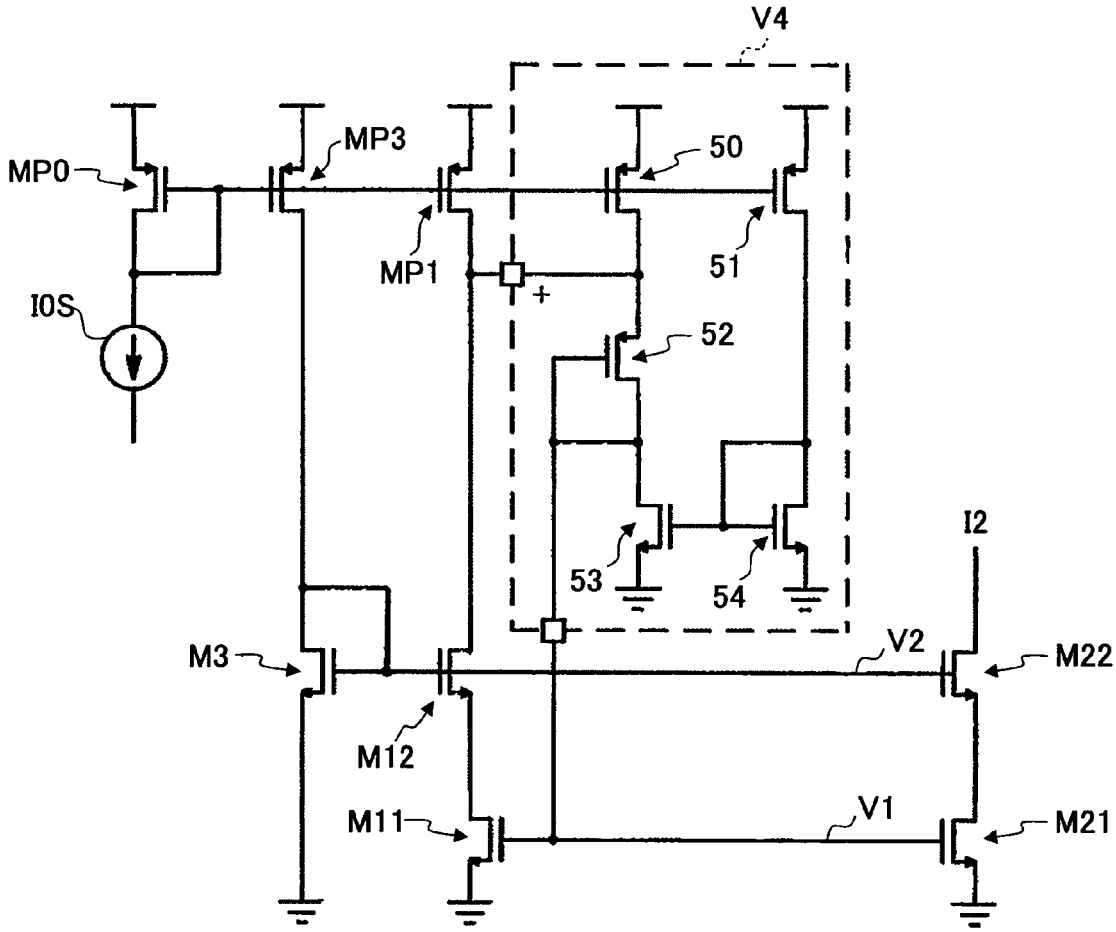
FIG. 9 is a circuit diagram showing an example of the circuit construction of a bias-voltage generating circuit and shift-voltage generating circuit shown in FIG. 8.

FIG. 9 is a circuit diagram showing an example of the circuit construction of the bias-voltage generating circuit and shift-voltage generating circuit shown in FIG. 8. In FIG. 9, the same elements as those of FIG. 8 are referred to by the same numerals.

A transistor MP0 connected to a current source I0 and transistors MP1 and MP3 constitute a current mirror circuit, in which the transistors MP1 and MP3 each have a current I0 flowing therethrough. The transistor MP3 and the transistor M3 together make up the bias-voltage generating circuit V2 shown in FIG. 8. The transistor MP1 corresponds to the reference current source I1.

The shift-voltage generating circuit V4 in FIG. 9 includes PMOS transistors 50 through 52 and NMOS transistors 53 and 54. The PMOS transistor 52 is configured to have a diode connection, thereby generating a constant voltage between the plus node and minus node of the shift-voltage generating circuit V4. On the source side of the PMOS transistor 52, the PMOS transistor 50 is provides as a constant current source. On the drain side, the NMOS transistor 53 is provided as a constant current source. The PMOS transistor 51 and the NMOS transistor 54 constitute a circuit for making the NMOS transistor 53 a current source generating the same current amount as the PMOS transistor 50.

In this manner, the shift-voltage generating circuit V4 can generate a constant potential difference between the drain node of the transistor M12 and the gate node of the transistor M11. This achieves desired frequency response characteristics while securing an operation in the saturation region. In this example, the PMOS transistor 52 is used as a transistor configured in the diode connection. An NMOS transistor may as well be used to implement an almost identical configuration.

Further, the present invention is not limited to these embodiments, but various variations and modifications may be made without departing from the scope of the present invention.

The present application is based on Japanese priority application No. 2004-346826 filed on Nov. 30, 2004, with the Japanese Patent Office, the entire contents of which are hereby incorporated by reference.

What is claimed is:

1. A current mirror circuit, comprising:

a first transistor having a source node connected to a reference potential; a second transistor having a source node coupled to a drain node of the first transistor and a gate node connected to a first predetermined potential;

an inverted amplification circuit having a non-inverted input node coupled to a drain node of the second transistor, an inverted input node coupled to a second predetermined potential, and an output node coupled to a gate node of the first transistor;

a third transistor having a gate node connected to a potential substantially equal to a potential of the gate node of the first transistor; and a fourth transistor having a gate node connected to a potential substantially equal to a potential of the gate node of the second transistor, wherein the first predetermined potential and the second predetermined potential are equal to each other.

2. The current mirror circuit as claimed in claim 1, further comprising a current source coupled to the drain node of the second transistor.

* * * * *